US008087475B2

(12) United States Patent
Habel et al.

(10) Patent No.: US 8,087,475 B2
(45) Date of Patent: Jan. 3, 2012

(54) ELECTRICAL POWER TOOL

(75) Inventors: Winfried Habel, Leinfelden-Echterdingen (DE); Frank Fuchs, Rutesheim (DE); Andreas Schlegel, Leinfelden-Echterdingen (DE); Holger Frank, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 402 days.

(21) Appl. No.: 11/291,834

(22) Filed: Dec. 1, 2005

(65) Prior Publication Data

US 2006/0186743 A1 Aug. 24, 2006

(30) Foreign Application Priority Data

Feb. 18, 2005 (DE) ..... 10 2005 007 546

(51) Int. Cl.
*B25F 5/00* (2006.01)

(52) U.S. Cl. ..... 173/217; 173/171; 310/47; 310/50

(58) Field of Classification Search ..... 173/217, 173/117, 109, 171; 310/47, 50
See application file for complete search history.

(56) References Cited

U.S. PATENT DOCUMENTS

| | | | | |
|---|---|---|---|---|
| 2,456,571 | A * | 12/1948 | Turner et al. | 310/50 |
| 4,314,170 | A | 2/1982 | Sahrbacker | |
| 5,052,497 | A * | 10/1991 | Houben et al. | 173/109 |
| 6,043,575 | A * | 3/2000 | Ghode et al. | 310/52 |
| 6,123,158 | A * | 9/2000 | Steffen | 173/217 |
| 6,127,751 | A | 10/2000 | Kristen et al. | |
| 6,325,157 | B1 * | 12/2001 | Arakawa et al. | 173/201 |
| 6,543,549 | B1 * | 4/2003 | Riedl et al. | 173/216 |
| 6,552,904 | B2 * | 4/2003 | Fung | 361/704 |
| 6,776,245 | B2 * | 8/2004 | Kristen et al. | 173/217 |
| 6,866,105 | B2 * | 3/2005 | Pfisterer et al. | 173/117 |
| 6,909,207 | B2 * | 6/2005 | Ikeda et al. | 310/47 |
| 7,064,462 | B2 * | 6/2006 | Hempe et al. | 310/50 |
| 7,166,939 | B2 * | 1/2007 | Voigt et al. | 310/47 |
| 2003/0030984 | A1 | 2/2003 | Fung | |

FOREIGN PATENT DOCUMENTS

| | | |
|---|---|---|
| EP | 0 984 545 A2 | 3/2000 |
| EP | 1 491 290 | 12/2004 |

* cited by examiner

*Primary Examiner* — Scott A. Smith
(74) *Attorney, Agent, or Firm* — Michael J. Striker

(57) ABSTRACT

An electric power tool has a housing having an inlet opening and an outlet opening, a drive motor contained in the housing, an electronic unit for controlling and regulating the drive unit, a fan a main air conduit extending between the inlet opening and the outlet opening of the housing, the drive motor being situated in the main air conduit supplyable with cooling air, and a heat sink operative for indirectly cooling the electronic unit.

7 Claims, 1 Drawing Sheet

ELECTRICAL POWER TOOL

CROSS-REFERENCE

The invention described and claimed hereinbelow is also described in DE 10 2005 00 7546.0, filed Feb. 18, 2005. This German Patent Application, whose subject matter is incorporated here by reference, provides the basis for a claim of priority of invention under 35 U.S.C. 119 (a)-(d).

BACKGROUND OF THE INVENTION

The present invention relates to an electric power tool.

In known electric power tools, for example rotary hammers, an electronic unit is provided to control and/or regulate a drive motor. The high temperatures generated during operation of the electric power tool can cause malfunctions. To avoid this problem, usually a cooling device is provided to extend the service life of the drive motor and electronic unit. The electronic unit according to the prior art is mounted directly in the air flow, which circulates around it and cools it. The problem with this design is that the electronic unit comes into contact with drilling dust, moisture, or conductive particles that are sucked in through an intake opening. This problem is particularly pronounced in overhead work. This considerably limits the service life of the motor because erosion in the rotor and stator occurs, caused by dust and/or drilling particles.

In a modification of the known electric power tool, two separate air conduits are provided, a first air conduit for cooling the motor and a second air conduit for cooling the electronics.

In European Patent Application EP 984 545 A2, for example, a fan impeller sucks in cool surrounding air via two separate air conduits and then, mixed together, blows it out from the electric power tool. The air conduits, which are separate on the intake side until they reach the fan impeller, circulate around a hammer mechanism and transmission in a first air conduit and circulate around the drive motor and electronics in a second air conduit. It is disadvantageous here that an intake opening associated with the second air conduit is situated upstream of the motor in the air conduit so that first the electronics, then the motor, and finally the rest of the machine is cooled, which significantly reduces the cooling capacity.

SUMMARY OF THE INVENTION

Accordingly, it is an object of the present invention to provide an electrical power tool, which eliminates the disadvantages of the prior art.

In keeping with these objects and with others which will become apparent hereinafter, one feature of the present invention resides, briefly stated, in an electric power tool, comprising a housing having an inlet opening and an outlet opening; a drive motor contained in said housing; an electronic unit for controlling and regulating said drive unit; a fan; a main air conduit extending between said inlet opening and said outlet opening of said housing, said drive motor being situated in said main air conduit supplyable with cooling air; and a heat sink operative for indirectly cooling said electronic unit.

In an electric power tool according to present invention, an electronic unit can be indirectly cooled by means of a heat sink. The sensitive electronic unit is advantageously situated outside the main air conduit and is consequently not in direct contact with the cooling air so that the electronic unit is also not exposed to the possible penetration of steel chips, drill cuttings, or other dust particles and is protected from environmental influences and dirt particles. The proposed cooling principle achieves an optimal cooling in a given amount of space. In addition, the electric power tool according to the present invention is distinguished by a simple, rugged structural design. In addition, the amount of time required for assembly remains within limits and repair work is easy to perform.

In a preferred embodiment form, a secondary cooling flow is provided, which flows over the heat sink; the secondary cooling flow feeds into the main air conduit between the fan and the drive motor, permitting an effective removal of waste heat.

In a particularly preferable embodiment, the electronic unit is connected in a thermally conductive manner to the heat sink situated outside the main air conduit. The heat sink itself can be cooled while the electronic unit has no direct contact with the cooling air. The heat sink can, for example, be comprised of a cooling plate or an otherwise thermally conductive material.

Preferably, the electronic unit is situated in a region of the housing that is protected from contamination in order to offer additional protection from impurities merely by means of its placement. In addition, an intake opening associated with the main air conduit can be embodied in the form of a number of slots situated parallel to one another. It is also possible for the intake opening to open away from an operating direction and for it to be provided with dust protection.

According to the present invention, the heat sink is situated in a negative pressure region of a secondary cooling flow of the main air conduit and is cooled by a cooling air flow. The heat sink thus advantageously always supplies the electronic unit with cooler intake air from a secondary cooling flow.

A preferred intake point is situated in a negative pressure region between a commutation unit of the drive motor and an air guide element. The air guide element can, for example, be provided in the form of an air guide ring or an air guide grating. Advantageously, the cooling of the electronic unit preferably occurs on an intake side of the motor, which permits more thermal output to be carried away than in devices with outlet air cooling in which the components to be cooled are blown with warm outlet air.

Preferably, the heat sink conveys the waste heat of the electronic unit into an outlet region of the main air conduit, which permits the warm outlet air to be conveyed outward rapidly. On the outlet side of the drive motor, a fan impeller can be provided, which improves the conveying of exhaust heat outward. This permits a favorable improvement of the cooling capacity.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
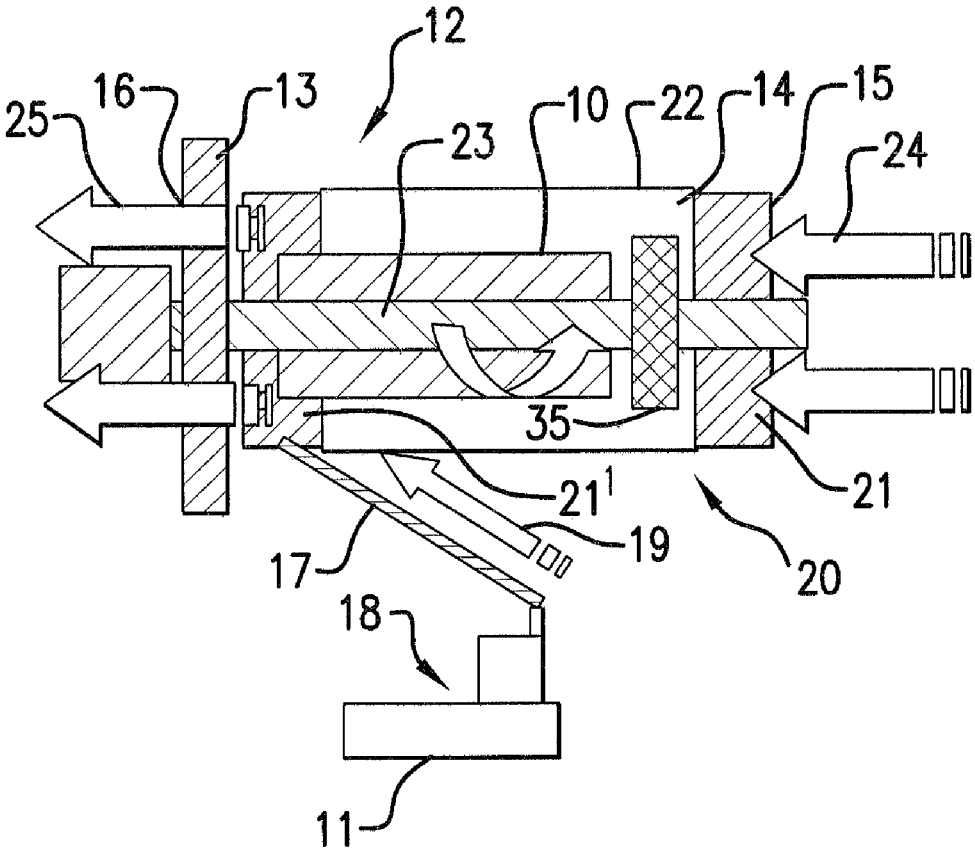
FIG. 1 schematically depicts a sectional view of an electric power tool according to the present invention, with a commutation unit positioned internally.

The sole figure schematically depicts an embodiment form of an electric power tool according to the present invention. A housing 12 contains a drive motor 10, an electronic unit 11 for controlling and regulating the drive motor 10, and a fan 13.

The drive motor 10 has a stator 22 and a rotor 23 provided with a motor winding. In a line-power device, a poll shoe, for example, can be provided instead of the stator 22. The drive motor 10 is situated in a main air conduit 14 between an intake opening 15 and an outlet opening 16 of the housing 12. Cold intake air 24 is sucked in through the intake opening 15. The intake air 24 then travels into the main air conduit 14, circulates around the drive motor 10 there, and is blown out again by the fan 12 in the form of a fan impeller so that the hot outlet air 25 exits on the outlet side.

The electronic unit 11 is situated in a region 18 of the housing 12 that is protected from contamination. According to present invention, the electronic unit 11 is cooled indirectly by means of a heat sink 17. The heat sink 17 is comprised of a cooling plate that is connected to the electronic unit 11 in a thermally conductive manner, particularly in a solidly joined, thermally conductive manner.

The heat sink 17 is situated outside the main air conduit 14 and is supplied with cold intake air 24 via a secondary cooling flow 19 of the main air conduit 14. But the secondary cooling flow 19 is not provided in a separate air conduit offset from the main air conduit 14; instead, the secondary cooling flow 19 feeds into the main air conduit 14 upstream of the fan 13. The electronic unit 11 is thus cooled without being struck directly by the cooling air. This cooling principle assures good protection from contamination by dust particles and the like. At the same time, it affords considerable protection from other environmental influences such as moisture.

The heat sink 17 is situated in a negative pressure region of the secondary cooling flow 19 of the main air conduit 14 and can thus be cooled by a cooling air flow. An intake point 20 for the secondary cooling flow 19 is situated in the negative pressure region between a commutation unit 35 of the drive motor 10 and an air guide element 21.

The air guide element 21 has a special intake geometry that is not visible in the drawing. The air guide element can, for example, be provided in the form of an intrinsically known air guide ring or an intrinsically known air guide grating. In order to offer an additional protection from dust particles penetrating into the housing 12, the housing 12 can also be provided with cooling slots in the region of the intake opening 15. The cooling slots are not shown in the drawing. They are preferably situated inside, in the vicinity of a handle.

The heat sink 17 conveys the waste heat of the electronic unit 11 into an outlet region of the main air conduit 14 and the waste heat, together with the outlet air of the main air conduit, is conveyed outward in the form of exhaust air 25 by the fan 13. Downstream of the drive motor 10 and upstream of the fan 13, a second air guide element 21' is provided, which serves to optimize an air flow of the exhaust air 25.

It will be understood that each of the elements described above, or two or more together, may also find a useful application in other types of constructions differing from the types described above.

While the invention has been illustrated and described as embodied in an electric power tool, it is not intended to be limited to the details shown, since various modifications and structural changes may be made without departing in any way from the spirit of the present invention.

Without further analysis, the foregoing will reveal current knowledge, readily adapt it for various applications without omitting features that, from the standpoint of prior art, fairly constitute essential characteristics of the generic or specific aspects of the invention.

What is fully reveal the gist of the present invention that others claimed as new and desired to be protected by Letters Patent is set forth in the appended claims.

The invention claimed is:

1. An electric power tool, comprising:

a housing having an inlet opening and an outlet opening;

a drive motor contained in said housing;

a fan contained in said housing;

a main air conduit extending between said inlet opening and said outlet opening of said housing, said drive motor being situated in said main air conduit supplied with cooling air;

an electronic unit disposed outside of said main air conduit, wherein said electronic unit is configured to control and regulate said drive unit;

a heat sink disposed outside of said main air conduit, said heat sink comprising a cooling plate connected to the electronic unit in a thermally conductive manner and configured to cool said electronic unit, wherein said cooling plate is positioned to be contacted by said cooling air via a secondary cooling flow and to prevent said secondary cooling flow from directly impinging said electronic unit, wherein said secondary cooling flow feeds into the main air conduit upstream of said fan.

2. An electric power tool as defined in claim 1, wherein said housing has a region which is protected from contamination, said electronic unit being situated in said region of said housing which is protected from contamination.

3. An electric power tool as defined in claim 1, wherein said heat sink is configured so that the heat sink conveys a residual heat of said electronic unit into an outlet region of said main conduit.

4. An electric power tool as defined in claim 1, wherein said heat sink is situated in a negative pressure region of the secondary cooling flow of said main air conduit.

5. An electric power tool as defined in claim 4, wherein said drive motor has a commutation unit; and further comprising an air guide element; and an intake point which is situated in said negative pressure region between said commutation unit of said drive motor and said air guide element.

6. An electric power tool as defined in claim 1, further comprising means for forming said secondary cooling flow, wherein said secondary cooling flow feeds into said main air conduit between said fan and said drive motor.

7. An electric power tool, comprising:

a housing having an inlet opening and an outlet opening;

a drive motor contained in said housing;

a fan contained in said housing;

a main air conduit extending between said inlet opening and said outlet opening of said housing, said drive motor being situated in said main air conduit supplied with cooling air;

an electronic unit disposed outside of said main air conduit, wherein said electronic unit is configured to control and regulate said drive unit;

a heat sink comprising a cooling plate operative for indirectly cooling said electronic unit and arranged so that the cooling air contacts only one side of the cooling plate, wherein the electronic unit is located at an opposite side of the cooling plate, so that while the cooling plate at the one side is impinged and cooled by the cooling air, the electronic unit at the other opposite side is not struck by the cooling air.

* * * * *